US010214850B2

(12) United States Patent
Santillan Galvan

(10) Patent No.: US 10,214,850 B2
(45) Date of Patent: Feb. 26, 2019

(54) INTELLIGENT ELECTRONIC SYSTEM FOR REMOVING WRINKLES ON TEXTILE CLOTHES AND METHOD FOR CARRYING OUT SAID WRINKLE REMOVAL

(71) Applicant: MABE, S.A. DE C.V., Santiago de Queretaro, Queretaro (MX)

(72) Inventor: Raul Santillan Galvan, Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 435 days.

(21) Appl. No.: 14/561,715

(22) Filed: Dec. 5, 2014

(65) Prior Publication Data

US 2015/0176193 A1 Jun. 25, 2015

(30) Foreign Application Priority Data

Dec. 19, 2013 (MX) ..... MX/a/2013/015344

(51) Int. Cl.
*F26B 11/02* (2006.01)
*D06F 58/20* (2006.01)
*D06F 58/28* (2006.01)

(52) U.S. Cl.
CPC ..... *D06F 58/203* (2013.01); *D06F 58/28* (2013.01); *D06F 2058/2877* (2013.01); *D06F 2058/2896* (2013.01)

(58) Field of Classification Search
CPC ..... D06F 58/203; D06F 58/28; D06F 2058/2896; D06F 2058/2877; D06F 2058/2816; D06F 2058/2861; D06F 33/02
USPC ..... 34/597, 381, 382; 68/200, 205 R, 207
See application file for complete search history.

(56) References Cited

U.S. PATENT DOCUMENTS

| | | | | |
|---|---|---|---|---|
| 4,207,683 | A | 6/1980 | Horton | |
| 7,325,330 | B2 | 2/2008 | Kim et al. | |
| 8,104,191 | B2 | 1/2012 | Ricklefs et al. | |
| 8,187,387 | B2 | 5/2012 | Kim et al. | |
| 8,272,090 | B2 | 9/2012 | Park et al. | |
| 2004/0143994 | A1* | 7/2004 | Baron | D06F 35/00 34/597 |
| 2010/0000113 | A1* | 1/2010 | Chernetski | D06F 58/203 34/389 |
| 2010/0050464 | A1 | 3/2010 | Krzelowski et al. | |
| 2011/0047812 | A1* | 3/2011 | Sugimoto | D06F 58/28 34/427 |
| 2011/0107617 | A1* | 5/2011 | Lee | D06F 58/203 34/427 |
| 2012/0312321 | A1* | 12/2012 | Armstrong | B08B 1/001 134/6 |

(Continued)

FOREIGN PATENT DOCUMENTS

WO 20100120146 10/2010

*Primary Examiner* — John McCormack
(74) *Attorney, Agent, or Firm* — Terry M. Sanks, Esq.; Beusse Wolter Sanks & Maire, PLLC

(57) ABSTRACT

An intelligent electronic system for removing wrinkles from a textile clothes load, including an electronic integrated circuit of the microcontroller type placed preferably integrally on the mainboard of the dryer machine located on the control panel, an user interface located preferably on the control panel allowing communications between the user and the dryer machine, and a water-injection means located at the drum's air inlet. A process for removing wrinkles on textile clothes is also disclosed.

1 Claim, 2 Drawing Sheets

(56) References Cited

U.S. PATENT DOCUMENTS

| | | | | |
|---|---|---|---|---|
| 2013/0104318 | A1* | 5/2013 | Kappler | D06F 33/02 8/137 |
| 2014/0060595 | A1* | 3/2014 | Alexander | D06F 39/005 134/56 R |
| 2014/0109428 | A1* | 4/2014 | Kim | D06F 58/206 34/86 |

* cited by examiner

INTELLIGENT ELECTRONIC SYSTEM FOR REMOVING WRINKLES ON TEXTILE CLOTHES AND METHOD FOR CARRYING OUT SAID WRINKLE REMOVAL

CROSS-REFERENCE TO RELATED APPLICATIONS

This application claims priority to Mexican Patent Application No. MX/a/2013/015344 filed Dec. 19, 2013, and incorporated herein by reference in its entirety.

FIELD OF THE INVENTION

The present invention relates to principles and techniques used in the Home Appliances Industry for the development of new systems and processes allowing to perform some of the routine home duties more easily, and in a safety and reliable manner, and more particularly, it is related to a process for removing wrinkles on textile clothes, applicable to an automatic dryer machine for home use.

BACKGROUND OF THE INVENTION

The cleaning process of a large number of garments, bed clothing and linen in general can be circumscribed to the steps of washing, drying and ironing.

It is well known that after the drying and washing steps clothes have faulty or irregular creases commonly denoted as "wrinkles", therefore said clothes must be ironed to smoothen or flatten said wrinkles. It is not enough to use a perfectly cleaned garment, but having all the lines erased by wrinkles. While molecules are hot fibers are stretched by the iron's weight and keep their new shape when cooled. Some materials like cotton, require the addition of water to loosen intermolecular links. Many modern materials are advertised as requiring little ironing or none.

It is well known that water and heat are the most commonly used for removing wrinkles from textile clothes, because when water contacts fibers it expands or stretches them, thus wrinkles are smoothed, while heat sets said smoothening such that wrinkles are removed. Within this context, steam (water and heat) is most commonly used for removing wrinkles from textile clothes.

For many years conventional dryers use steam for drying, and, in some instances, for removing wrinkles from textile clothes, however, this is a very costly technology.

There are known tricks for removing wrinkles from clothes, such as using steam produced in the bathroom shower, in this case, garments are previously humidified with a clean cloth and hanged away from the shower to advantageously use the steam. While this trick is useful, wrinkles don't disappear at all, besides it results in an important waste of water.

Another trick is to use a hair dryer, wherein again a wet cloth is used and then the hair dryer is passed over the wrinkles, while the garment is stretched and thus removes said wrinkles.

Also, some people use a hair straightener, and similarly the wrinkled area is humidified and then the hair straightener is passed over the wrinkles with care so as to not deteriorate the garment.

For the removal of wrinkles from garments, there are softeners sprays in the market, which help fabrics to adopt its natural shape and therefore smoothen wrinkles. There are liquid softeners as well, which are used right after washing and just before drying clothes.

Finally, there is the use of a clothes dryer, in this case, garments are humidified with a wet cloth and then placed inside the dryer for a period of time, then said hot garment is removed and hanged in order to remove the wrinkles.

As can be seen from the foregoing, those tricks for removing wrinkles from garments and linen in general can be acceptable, but not effective at all, being just a temporary solution to get rid of wrinkles.

Nowadays, many models and trademarks of automatic clothes dryers exist in the state of the art, which include the unwrinkle processes, such as is disclosed in the U.S. Pat. No. 4,207,683, which refers to an improvement on conventional clothes dryers including a spray nozzle, a control valve, and a water line coupled to a water source. The touch-up spray is used for removal of wrinkles from clothing and fabrics and permanent press clothing in particular without removing a garment's factory set creases. The apparatus may also include a water heating unit for spraying water of a selected temperature or steam. The apparatus may further be provided with a liquid additive dispenser for dispensing static electricity removal agents and clothes softening fluids.

U.S. Pat. No. 7,325,330 discloses an apparatus and method for eliminating wrinkles in clothes in a washing or drying machine using steam to eliminate wrinkles in clothes, in a state in which the clothes are worn by a user or stored, as well as in a state in which washing of the clothes has ended. The method includes determining whether or not a wrinkle-eliminating procedure is selected; supplying hot air to the clothes to eliminate dust from the clothes when it is determined that the wrinkle-eliminating procedure is selected, and supplying steam to the clothes, from which the dust was eliminated, to remove the wrinkles from the clothes.

U.S. Pat. No. 8,104,191, describes a laundry dryer including a rotatable drum, an air delivery system selectively operable to provide air into the drum at a first flow rate and a second flow rate that is less than the first flow rate, and a moisture delivery system operable to provide moisture (e.g., water mist or steam) into the drum while air is being provided at the lower second flow rate, and during drum rotation, to thus enhance dispersion of moisture into the fabrics of the load. The air delivery system can include a reversible blower that provides air at the first flow rate when operated in a first direction and provides air at the second flow rate when operated in an opposite second direction. The drum can be a reversibly rotatable drum that is rotatable in a first and an opposite second direction, and the dryer can include a drive motor that both rotates the drum and operates the blower. The moisture delivery system can include a nozzle to provide moisture directly into the drum.

U.S. Pat. No. 8,187,387 refers to a dryer and a method of controlling a cleaning operation thereof that are capable of supplying moisture into a drying chamber of the dryer to wet contaminants in the drying chamber and blowing air to the wet clothes to remove the contaminants in contact with the means to eliminate contaminants. The method includes supplying moisture into a drying chamber to wet contaminants in the drying chamber and removing the contaminants wetted by the moisture.

U.S. Pat. No. 8,272,090 describes a method for operating a washing machine, in which wrinkles are removed from laundry using steam. The method includes supplying steam of a high temperature to a drum containing laundry, and supplying air to the drum. The method facilitates the refreshing of the clothes, thus allowing a user to wear the clothes just after the refreshing of the clothes.

U.S. Patent Application Serial No. US2010/0050464 A1 relates to a clothes dryer comprising a drying drum with an airflow inlet and a motor for rotating the drum. A blower rotated by a fan motor flows air into, through, and out the drum. A refresh or touch-up de-wrinkle course is selected via a signal input on a control panel. Steam is supplied to the drum by a steam generating device, and heated air from a heater is supplied via the inlet. A controller operates the steam device and the heater, in response to the procedure that has been selected, to supply to the drum a plurality of steam pulses of at least one first predetermined time and a heated air pulse after each steam pulse. Heated air pulses between steam pulses are intermediate pulses of at least one second predetermined time to reduce condensation in the dryer and the final pulse of heated air is of a duration to dry clothes.

On the other hand, U.S. Patent Application Serial No. US2011/0107617 A1 discloses a control method for drying clothes that sprays an appropriate amount of water based on the amount of clothes and dries the clothes at a fiber rearrangement temperature to remove wrinkles from the clothes. Standard regain of clothing is confirmed, the mist is sprayed such that an equivalent amount of mist can regain approximately twice the clothes, and the clothes are dried at the fiber rearrangement temperature, whereby wrinkles are removed from the clothes.

International Patent Application No. PCT/KR2010/002379 (international Publication No. WO 2010/120146) relates to an operating method for a clothes dryer, which has a rotatable drum mounted inside a main body, a heater for heating the air flowing into the drum; and a scent supplying module for spraying scent into the drum, comprising: a drying step of drying clothes by supplying hot air heated by the heater; a pre-treating step of tumbling the drum while supplying hot air; and a scent treating step of spraying scent onto the clothes which has passed through the pre-treating step. Since the scent is sprayed on after the pre-treating step, the scent can be effectively deposited on the clothes.

According to the above, it can be seen from the documents found in the state of the art that there is a great deal of machines and methods for the removal of wrinkles from textile clothes, where all of them use steam to that end, thus making this process highly expensive as a steam generating unit must be included in dryers and, on the other hand not being effective enough to remove wrinkles.

In view of the above, an intelligent electronic system for removing wrinkles on textile clothes was developed, as well as a method to carry out said wrinkle removal, wherein both are applicable to any automatic dryer machine for home use.

BRIEF DESCRIPTION OF THE INVENTION

Thanks to the technical and structural features of dryer machines, these can be used to remove wrinkles from textiles clothes after they have been washed and dried, or, where said textile clothes wrinkled after having been stored for a period of time.

In view of the above, an intelligent electronic system of the present invention was developed, comprising: an electronic integrated circuit (not shown in the figures) of the microcontroller type placed preferably integrally on the mainboard of the dryer machine (100) located on the control panel (8); an user interface located preferably on the control panel (9) allowing communications between the user and the dryer machine (100); water-injection means (10) located preferably at the drum's air inlet or in another embodiment at the drum's air outlet.

Furthermore, a process for removing wrinkles from textiles clothes is provided, comprising the steps of (a) Placing dry, wrinkled textile clothes into the drum of an automatic dryer machine.

(b) Injecting an amount of water in a mist or spray form into the drum, which is idle, in order to moisten the textile clothes by using the water injection means, said amount of water being in proportion with the total weight of textile clothes to be treated, so as to remove wrinkles according to the process of the present invention.

(c) Stopping the injection of the water mist and letting a period of time from 1 minute to 10 minutes to elapse, allowing the moisture to penetrate into the fibers of the textile clothes material and not only to remain on the surface thereof.

(d) Rotating the drum by turning on the motor of the dryer machine for a predetermined period of time from 1 to 10 minutes, after which the motor is turned off, and thereby all the textile clothes inside said dryer machine moisten homogeneously and not only those clothes that received the water mist.

(e) Repeating step b) at least one more time until all the previously predetermined amount of water is injected according to the total weight of the textile clothes.

(f) Repeating step c) at least one more time stopping the injection of water and allowing again for a period of time from 1 minute to 10 minutes to elapse so that the moisture penetrates into the fibers of the textile clothes material.

(g) Repeating step d) at least one more time rotating the drum again so that the textile clothes can totally and homogeneously be moistened.

If the textile clothes are not totally and homogeneously moistened, steps b) and d) are repeated successively until said textile clothes are totally and homogeneously moistened. If said textile clothes are indeed totally and homogeneously moistened then the process moves to the next step.

(h) Injecting a hot airflow in order to dry the clothes and allow for the wrinkles present on the textile clothes to disappear.

OBJECT OF THE INVENTION

Considering the drawbacks of the prior art, it is an object of the present invention to provide an intelligent electronic system, which is technically very simple but highly effective in removing wrinkles from textile clothes, applicable to an automatic dryer machine for home use, wherein said wrinkles occur due to storage or after a washing cycle.

A further object of the present invention is to provide an intelligent electronic system for removing wrinkles from textile clothes, applicable to an automatic dryer machine for home use, wherein the whole load of textile clothes homogeneously moisten by injecting water as a mist or spray into the dryer.

Still another object of the present invention is to provide an intelligent electronic system for removing wrinkles from textile clothes, applicable to an automatic dryer machine for home use, which allows for applying a required time so as to let the mist or spray formed by the injected water to penetrate into the fibers of the textile clothes, thereby removing said wrinkles.

Still further another object of the present invention is to provide an intelligent electronic system for removing wrinkles from textile clothes, applicable to an automatic dryer machine for home use, wherein the injection of hot water allows for setting the smoothening of wrinkles present on the textile clothes.

Still another object of the present invention is to provide a process for removing wrinkles from textile clothes applicable to an automatic dryer machine for home use.

BRIEF DESCRIPTION OF THE FIGURES

The novel aspects that are considered characteristic of the present invention are particularly set forth in the appended claims. The invention itself, however, both as to its construction and its method of operation, together with additional objects and advantages thereof, will be better understood from the following detailed description of a particularly preferred embodiment when read and understood in connection with the accompanying drawing, wherein:

DETAILED DESCRIPTION OF THE EMBODIMENTS OF THE INVENTION

As mentioned above in the Background of the Invention, using water and heat is more effective for removing wrinkles from textile clothes, because water smoothens wrinkles and heat sets said smoothening, such that wrinkles disappears. Taking advantage of such water and heat properties on textile clothes, a method for removing wrinkles from textile clothes was developed, along with an intelligent electronic system for its application in any automatic dryer machine for home use, as described and claimed in a particularly preferred embodiment of the present invention.

Figure 1:
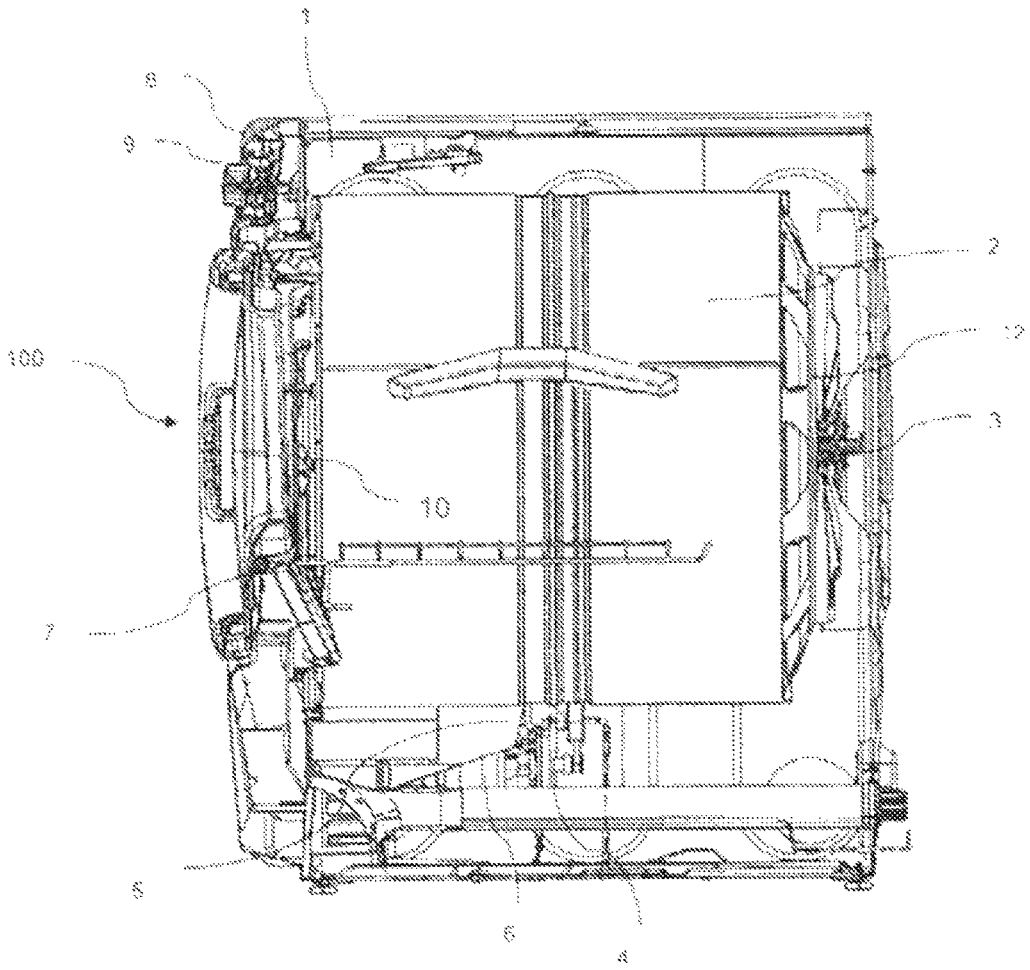
FIG. 1 is a schematic view showing the internal structure of an automatic dryer machine for home use, which uses a process for removing wrinkles from textile clothes.

Referring to the accompanying drawings, and more specifically to FIG. 1, the internal structure of an automatic electronic clothes dryer machine (100) for home use is shown therein, whose main function is to dry clothes. However, thanks to the technical and structural features said dryer machine (100) can be employed for removing wrinkles from textile clothes, this is achieved by integrating said intelligent electronic system into said dryer machine (100) so as to allow carrying out the removal of wrinkles, wherein said electronic system will allow for the dryer machine (100) to make decisions according to preset conditions and parameters.

In order to further clarify and better understand the present invention, the dryer machine (100) shown in FIG. 1 is only intended to illustrate rather than to limit the intelligent electronic system for removing winkles from textile clothes as described according to a particularly preferred embodiment of the present invention, since said intelligent electronic system as well as the method of implementing the same, can be applied in any automatic clothes dryer machine.

Said dryer machine (100) is of a type comprising: a main body (1) or cabinet; a rotatory drum (2) arranged in the center of the dryer machine (100); heating means (3) located preferably on the rear portion (12) of the drum (2); a motor (4) located on the lower portion of the dryer machine (100); a propeller fan (5) located on the lower portion of the dryer machine (100), arranged above the motor (4); a motor of said fan (6) located in front of the motor (4); temperature sensing means (7) located at the outlet and inlet of the drum (2) and a control panel (8) located on the outside on the upper section of the front wall (10).

The main body (1) or cabinet shapes the exterior appearance of the dryer machine (100) and comprises on its front wall an opening through which dry and wrinkled textile clothes, such as clothes, bed clothing and linen in general, are place inside said dryer machine (100).

The heating means (3) operates to inject hot air into the dryer machine (100) to allow a total removal of humidity from the textile clothes, and accordingly allowing the removal of wrinkles.

Motor (4) is a power source transmitting motion to the drum (2) for rotation thereof.

The propeller fan (5) operates to create a vacuum pressure that results in an airflow first passing through the heating means (3) and then the resulting hot air passing through the clothes while the clothes rotate inside the drum (2).

The temperature sensing means (7) comprise a plurality of sensors which mainly operate to sense or detect the temperature at the inlet and outlet of the drum (2).

Control panel (8) includes all the programmed information that allows for the control of the automatic operations of the dryer machine (100).

Now, referring more specifically to the intelligent electronic system of the present invention, which comprises: an electronic integrated circuit (not shown in the figures) of the microcontroller type placed preferably integrally on the mainboard of the dryer machine (100) located on the control panel (8); an user interface located preferably on the control panel (9) allowing communications between the user and the dryer machine (100); water-injection means (10) preferably located at the drum's inlet and outlet.

The microcontroller comprises in an integral manner a memory for storing the conditions and parameters previously established, wherein said memory can be a Random Access Memory (RAM) or an Electrically Erasable Programmable Read Only Memory (EEPROM), being preferably a RAM memory. Also, said microcontroller is programmable in a microcontroller assembly language within a programming environment. Additionally, said microcontroller has a specific programming frequency and an instruction cycle time.

The user interface is preferably of the hardware type, besides it is a touch interface to allow the user to interact with one finger similarly to actuating a physical control.

The water injection means (10) are comprised of at least one nozzle or spray valve, which injects a water spray or mist to moisten textile clothes and subsequently remove wrinkles thereon.

The microcontroller is programmed such that the injection time of said spray or mist is to be controlled based on a number of cycles until all the required water is injected so as to have a desired initial moisture content (IMC), which, in the particularly preferred embodiment of the present invention, the total amount of water corresponds to 70 to 90%, preferably 80% of the total load to be unwrinkled, said IMC range results in wrinkle removal comparable to that achieved by a commercial dry-cleaning service. For example: for a long sleeve shirt weighing about 227 g (0.5 lb), the amount of water to moisten said shirt will be 181 g (0.4 lb) equivalent to approximately 0.18 Lt of water. In a preferably alternative embodiment, the IMC can range between 20% to 50%, which comprise a moderate wrinkle removal; in another preferred embodiment, the IMC ranges from 50% to 70% providing an average wrinkle removal.

The reason why water injection has to be done by cycles is due to the fact that the load must be homogeneously moistened in order to remove wrinkles therefrom, that is to say: the load has to be moistened on all of its sides rather than only on certain portions thereof, so it is important that during said injection of water into the drum (2), said drum must be idle and after each water injection into the drum (2), it must be rotated so as to modify the load's position therein, thereby each garment of the load to be unwrinkled is moistened in a homogeneous fashion.

Therefore, once water is injected in a first period of time from 1 minute to 5 minutes, the specific time depends on the dryer's construction design and engineering criteria (type of drum, power of air heating elements, volume of air supplied into the drum, etc.) as well as the type of nozzle, the working pressure of the nozzle, besides the load volume or amount of objects to be unwrinkled placed inside the drum; further, according to the engineering and design criteria above mentioned, the parameter (t1) is determined for each particular model of dryer, once said time interval has elapsed the spray valve or nozzle (10) is deactivated thereby stopping the injection of water, and then allowing a second period of time from 1 to 10 min, to elapse, the length of this second period depends on design or engineering criteria as mentioned above, besides the load volume or amount of objects to be unwrinkled placed inside the drum; according to a second parameter ($t_2$) in order to let the water to penetrate into the fabric fibers and not only moisten the surface of garments, and then allowing the drum (2) to rotate. This operation is repeated for a given number of times, preferably 2 to 8 times, (the number of times this operation is repeated depends on design and engineering parameters as described above besides the load volume or amount of objects to be unwrinkled placed inside the drum); until all the water load has been and the clothes load is homogeneously moistened, thus achieving the desired IMC.

Once the load is homogeneously moistened, i.e. the water already have worked in removing the wrinkles, the motor is turned on and hot air is injected so as to dry the clothes and let the heat to work in setting the smoothening of said wrinkles.

Figure 2:
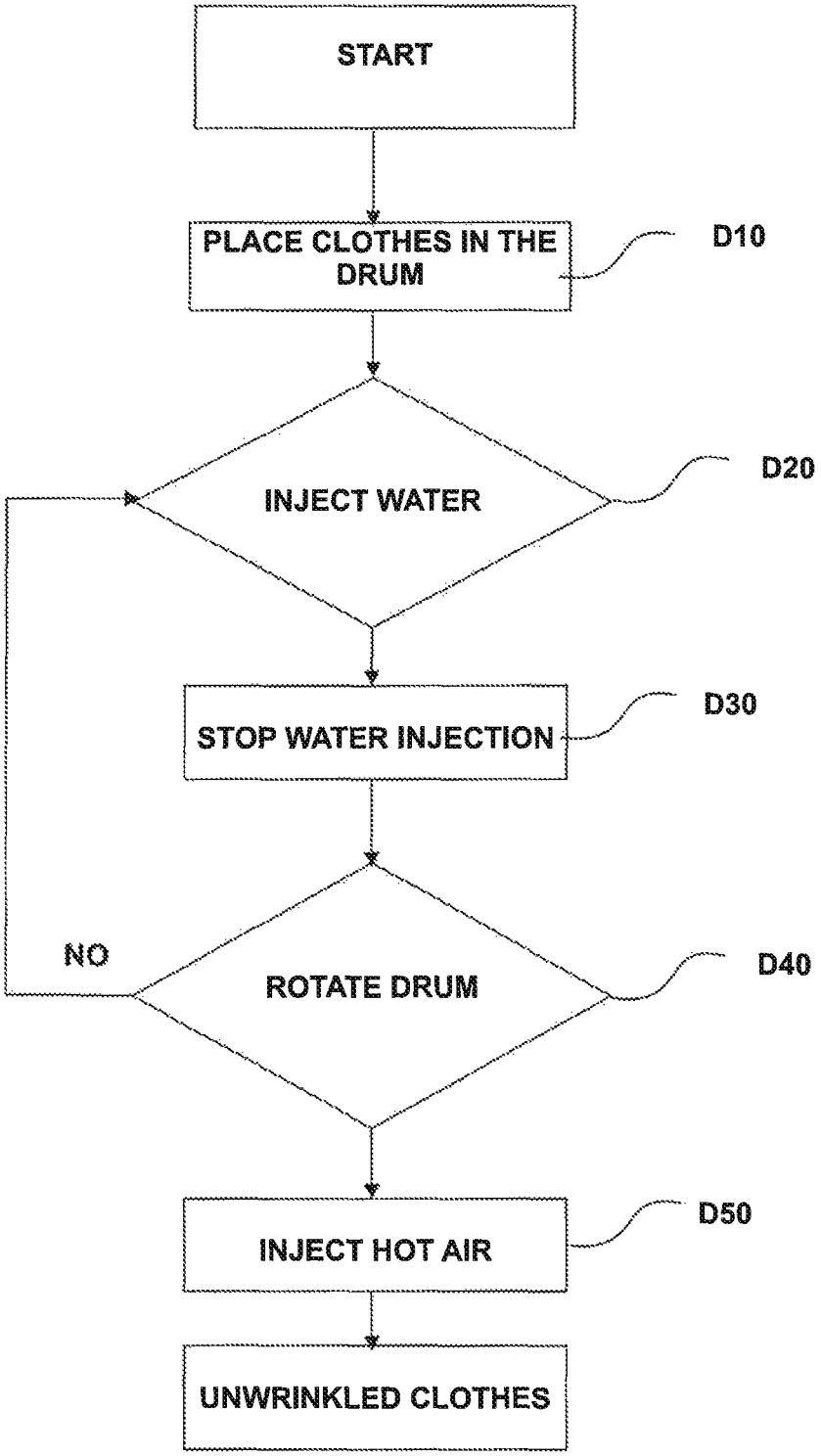
FIG. 2 is a flow diagram showing several steps of a process for removing wrinkles from textile clothes, developed with the principles of a particularly preferred embodiment of the present invention.

Now, referring more specifically to FIG. 2 of the accompanied drawings, there is shown several steps of a process to remove wrinkles from textiles clothes, which is applicable to an automatic dryer machine (100) for home use, wherein said process is described according to a particularly preferred embodiment of the present invention, comprising the steps of:

(a) Placing (D10) dry, wrinkled textile clothes into the drum (2) of the automatic dryer machine (100).

Injecting (D20) an amount of water in a mist or spray form into the drum (2), which is idle, in order to moisten the textile clothes by using the water injection means (7), said amount of water being in proportion with the total weight of textile clothes to be treated, so as to remove wrinkles according to the process of the present invention. In this particularly preferred embodiment, the total amount of water to be injected being in proportion to 70% to 90% of the total weight of textiles clothes inside the dryer machine (100), for example, if the total weight of textiles clothes is 6 kg, then the total amount of water to be injected will be 4.5 Kg to 5.1 Kg. In a preferably alternative embodiment, the IMC can range between 20% to 50%, which comprise a moderate wrinkle removal; in another preferred embodiment, the IMC ranges from 50% to 70% providing an average wrinkle removal.

(c) Stopping (D30) the injection of the water mist and letting a period of time from 1 minute to 10 minutes to elapse, allowing the moisture to penetrate into the fibers of the textile clothes material and not only to remain on the surface thereof.

(d) Rotating (D40) the drum (2) by turning on the motor (4) of the dryer machine (100) for a predetermined period of time from 1 to 10 minutes, after which the motor (4) is stopped, and thereby all the textile clothes inside said dryer machine (100) moisten homogeneously and not only those clothes that received the water spray.

(e) Repeating step b) at least one more time until all the previously predetermined amount of water is injected (D20) according to the total weight of the textile clothes.

(f) Repeating step c) at least one more time stopping the injection of water (D30) and allowing again for a period of time from 1 minute to 10 minutes to elapse so that the moisture penetrates into the fibers of the textile clothes material.

(g) Repeating step d) at least one more time, rotating (D40) the drum again so that the textile clothes can totally and homogeneously be moistened.

If the textile clothes are not totally and homogeneously moistened, then steps b) and d) are repeated successively until said textile clothes are totally and homogeneously moistened. If said textile clothes are indeed totally and homogeneously moistened then the process moves to the next step.

(h) Injecting (D50) a hot airflow in order to dry the clothes and allow for the wrinkles present on the textile clothes to disappear.

While the foregoing description has made reference to some embodiments of the process for removing wrinkles from textile clothes, applicable to an automatic dryer for home use of the present invention, emphasis should be made to a number of possible modifications to said embodiments, without departing from the true scope of the invention, such as modifying the number of the water-injection steps, the water-injection means and the arrangement thereof, the proportion of water to be injected, in an idle drum configuration using two motors, in a rotating drum configuration along with a fan, among many other modifications. Therefore, the present invention should not be limited except by what is established in the state of the art as well as by the appended claims.

The invention claimed is:

1. A process to remove wrinkles from textiles disposed within a dryer machine, a user that interacts with the dryer machine, wherein said dryer machine comprises a main body, a rotatory drum arranged in the center of the dryer machine, heating means, a motor that transmits motion to the drum, a propeller fan, a propeller fan motor that transmits motion to said propeller fan, temperature sensing means, a water injection means, a set of control conditions and parameters, a control panel that hosts the intelligent electronic system that includes a main board that contains a microcontroller, said microcontroller integrally comprises a memory for storing the conditions and parameters, wherein said memory can be a Random Access Memory (RAM) or an Electrically Erasable Programmable Read Only Memory (EEPROM); furthermore, said microcontroller is programmable in a microcontroller assembly language within a programming environment, having a specific programming frequency and an instruction cycle time; said dryer machine further comprises a user interface located on the control panel allowing communications between the user and the dryer machine, further characterized in that said user interface is of the hardware type, beside it is a touch interface allowing the user to interact with one finger similarly to actuating a physical control; said process to remove wrinkles comprises in the following order the steps of:

(a) placing dry textile clothes to be unwrinkled, inside the drum of the dryer machine and determining a quantity of water to be injected for a first predetermined period of time, according to the amount of the textile clothes to be unwrinkled, and a desired predetermined Initial Moisture Content (IMC);

(b) injecting water in the form of droplets, through the water injection means for a first predetermined period of time while the drum and propeller fan remain motionless, said water injection means comprises at least one nozzle, a spray valve, a portion that is activated for a first predetermined period of time allowing to flow a predetermined amount of water in the form of droplets that is sprinkled to the textile clothes to be unwrinkled disposed into the drum in order to reach a predetermined IMC, while the drum remains motionless;

(c) stopping the injection of the water once said first predetermined period of time has lapsed while the drum and propeller fan remain motionless and allowing for a second predetermined period of time to elapse, so that moisture penetrates into the fibers of the textile clothes material and not remaining just on the surface thereof;

(d) rotating the drum by turning on the motor of the dryer machine for a third predetermined period of time, after which the motor of the dryer is turned off;

(e) repeating steps (b), (c), (d) until the predetermined IMC is obtained, in order to ensure that all the textile clothes inside the drum are homogeneously moistened; and (f) rotating the drum by turning on the motor of the dryer machine and injecting hot air that passes thru the textile clothes by turning on the propeller fan motor and the heating means, thus to allow a total removal of humidity from the textile clothes and allowing the removal of wrinkles.

* * * * *